US011234562B1

(12) United States Patent
Simon

(10) Patent No.: US 11,234,562 B1
(45) **Date of Patent: *Feb. 1, 2022**

(54) HANDHELD PERSONAL PERINEAL CLEANSING SYSTEM AND METHODS

(71) Applicant: Kelley Simon, Las Vegas, NV (US)

(72) Inventor: Kelley Simon, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/908,028

(22) Filed: Jun. 22, 2020

Related U.S. Application Data

(63) Continuation-in-part of application No. 16/237,644, filed on Dec. 31, 2018, now Pat. No. 10,689,836.

(51) Int. Cl.
*A47K 3/28* (2006.01)
*E03C 1/20* (2006.01)
*E03C 1/12* (2006.01)

(52) U.S. Cl.
CPC ..... *A47K 3/281* (2013.01); *E03C 1/20* (2013.01); *E03C 2001/1213* (2013.01)

(58) Field of Classification Search
CPC ..... A47K 3/281
USPC ..... 4/443, 444, 447, 420.3, 445, 446
See application file for complete search history.

(56) References Cited

U.S. PATENT DOCUMENTS

| | | | |
|---|---|---|---|
| 2,749,558 | A | 6/1956 | Paul et al. |
| 3,577,567 | A | 5/1971 | Wintercorn |
| 3,626,941 | A | 12/1971 | Webb |
| 3,770,200 | A | 11/1973 | Bauer et al. |
| 3,849,806 | A | 11/1974 | Simpson et al. |
| 1,432,105 | A | 2/1984 | Pitroda |
| 4,791,686 | A | 12/1988 | Taniguchi et al. |
| 5,742,961 | A | 4/1998 | Casperson et al. |
| 5,933,881 | A | 8/1999 | Smith |
| 5,951,511 | A | 9/1999 | Lowder |
| 5,974,601 | A | 11/1999 | Drane et al. |
| 5,978,983 | A | 11/1999 | Queen et al. |
| 6,651,267 | B1 | 11/2003 | Utz |
| 6,785,915 | B1 | 9/2004 | Daugherty |
| 7,047,577 | B1 | 5/2006 | Cirilli |
| 7,774,871 | B1 | 8/2010 | Arsenault |
| 7,913,329 | B2 | 3/2011 | Smith |
| 8,185,982 | B1 | 5/2012 | Lizama et al. |
| 8,281,423 | B2 | 10/2012 | Taylor et al. |
| 8,677,520 | B2 | 3/2014 | Storm |
| 8,904,575 | B1 | 12/2014 | Lindheimer |
| 9,095,483 | B2 | 8/2015 | Storm |
| 2002/0083516 | A1 | 7/2002 | Wing et al. |
| 2004/0070238 | A1 | 4/2004 | Moser et al. |
| 2004/0237188 | A1 | 12/2004 | Marcellus |
| 2006/0247604 | A1 | 11/2006 | Bruno |
| 2007/0032765 | A1 | 2/2007 | Honda |
| 2009/0043267 | A1 | 2/2009 | Jackson |
| 2010/0306912 | A1 | 12/2010 | McCabe |
| 2017/0231866 | A1 | 8/2017 | Lenci |

*Primary Examiner* — Lori L Baker
(74) *Attorney, Agent, or Firm* — Connie R. Masters

(57) ABSTRACT

A handheld personal perineal cleansing system is provided that includes a water-ingress fitting for connecting to a waterpipe, one or more shut-off valves, a flexible feeder supply line attached to a distal end of the water-ingress fitting, an elongated spray arm attached to the distal end of the feeder supply line, at least one handle fixedly connected to the elongated spray arm, an accumulation basin, and a spray head disposed within the accumulation basin and having a nozzle assembly.

20 Claims, 8 Drawing Sheets

HANDHELD PERSONAL PERINEAL CLEANSING SYSTEM AND METHODS

CROSS REFERENCE TO RELATED APPLICATIONS

This application is a continuation-in-part of U.S. patent application Ser. No. 16/237,644 filed on Dec. 31, 2018 and issuing on Jun. 23, 2020 as U.S. Pat. No. 10,689,836, which is incorporated herein in its entirety.

FIELD OF INVENTION

This invention relates generally to bathing devices for hygienic purposes, and, more particularly, to a handheld personal perineal cleansing hygiene system attachable to existing bathroom plumbing lines or fixtures.

BACKGROUND OF THE INVENTION

A person that is handicapped, elderly, or otherwise has limited mobility may not be able to efficiently clean the perineal area, which is necessary for personal hygiene and comfort, as well as to prevent adverse skin conditions. For example, a person with limited mobility, such as a person with a severe back injury, may not be able to reach the anal area for removing feces after a bowel movement. It would be advantageous for the person with limited mobility to be able to stand upright or sit on the toilet while cleaning the perineal area, but the available cleaning devices have limitations and do not fully meet the needs of a person with limited mobility.

For example, handheld shower wands may be used to attempt to wash the perineal area, but the spray wand often has a spray that is too strong for the delicate skin of the perineal area, is typically too short, is hard to manipulate to direct the water delivery angle, and is angled incorrectly for directing the spray onto the perineal area. Additionally, washing feces onto the bottom surface of the shower or tub may not only be distasteful and unsanitary, but the person with limited mobility is not likely to be able to reach to the bottom surface of the shower or tub to clean and remove any residual waste.

Some perineal cleansing systems are designed for hospital use by a caregiver but are too complex and expensive for personal use. Some perineal cleansing systems, such as bidets, require major plumbing alternations to the bathroom in which it will be installed, necessitate that enough floor space be available for the bidet, and involve additional construction work.

Accordingly, a handheld personal perineal cleansing device is needed that is specifically designed to clean the delicate skin of the perineal area; that, when used in a shower or bathtub, prevents feces from being deposited on the floor of the shower or bathtub; that does not require major plumbing alternations during installation; that does not use additional floor space; and that does not involve any construction work to install.

BRIEF SUMMARY OF THE INVENTION

The present invention is directed to a handheld personal perineal cleansing hygiene system and methods of assembly and use that allows a person with limited mobility to efficiently clean the perineal area and that, when used in a shower or bathtub, prevents waste from accumulating on the shower floor or bathtub bottom surface. The handheld personal perineal cleansing system includes a water-ingress fitting (such as a tee fitting) for connecting to existing bathroom water piping, a flexible feeder supply line attached to the water-ingress fitting, a water-ingress valve to control the fluid flow into the water-ingress fitting and flexible supply line, an elongated spray arm attached to the distal end of the feeder supply line, at least one handle fixedly connected to the elongated spray arm, an accumulation basin, a spray head with a nozzle assembly disposed within the accumulation basin and connected to the distal end of the spray arm. In some embodiments, the handheld personal perineal cleansing system further includes a removal line attached to the accumulation basin and extending to a drain fitting, which may be disposed in the floor of a shower or a combination bathtub/shower or disposed at the entrance to the overflow drain of a combination bathtub/shower.

The handle allows the user to efficiently position the accumulation basin to allow the spray head nozzles to gently, but effectively, spray the delicate perineal area. When used in a shower or bathtub, any feces that may be washed away is collected in the accumulation basin that drains directly to the drain fitting to empty into the drain of the shower or bathtub, so no waste matter is deposited onto the shower floor. When used in a seated position on a toilet, the basin collects the sprayed water and waste and allows it to be hygienically deposited in the toilet.

The water input for the handheld personal perineal cleansing system comes from existing piping or fixtures in the bathroom. Thus, it is easily installed and does not require major plumbing changes or extensive modifications to a bathroom.

In contrast to a free-standing bidet, the handheld personal perineal cleansing system does not require any additional floor space be allocated to it.

In an aspect of the invention, the handheld personal perineal cleansing system includes a three-connection handle with connections to the spray arm at the top, middle and bottom of the handle.

In an additional aspect of the invention, the handheld personal perineal cleansing system includes a two-connection handle with connections to the spray arm only at the top and bottom of the handle.

In a further aspect of the invention, the handle of the handheld personal perineal cleansing system comprises a two-grip design that is easily grasped by two hands.

In another aspect of the invention, the handheld personal perineal cleansing system has an internal sprayer with nozzles directed upwardly for perineal cleansing and outwardly to rinse the interior of the sprayer.

In a further aspect of the invention, the handheld personal perineal cleansing system has an internal sprayer with nozzles directed upwardly only.

In an additional aspect of the invention, the handheld personal perineal cleansing system includes a sprayer with a single nozzle type.

In another aspect of the invention, the handheld personal perineal cleansing system includes a sprayer with multiple nozzle types.

In a further aspect of the invention, the handheld personal perineal cleansing system includes a handle interior reservoir, a handle input port that allows introduction of a fluid into the interior reservoir, and a handle shut-off valve that, when open, allows the fluid from the interior reservoir to enter the fluid flow passage of the spray arm.

In another aspect of the invention, the handheld personal perineal cleansing system includes a spray head with a separator shield.

In an additional aspect of the invention, the handheld personal perineal cleansing system includes a buttocks spreader system.

In a further aspect of the invention, the handheld personal perineal cleansing system includes a lid to cover the accumulation basin.

In another aspect of the invention, the handheld personal perineal cleansing system includes wall mounted holder that provides a location to store the cleaning system when not in use.

In an additional aspect of the invention, the handheld personal perineal cleansing system includes a two-part drain fitting having an interior portion connected to the removal line and an outer portion with holes allowing drainage of water into the plumbing drainpipe.

In a further aspect of the invention, the handheld personal perineal cleansing system is configured for installation in a shower.

In another aspect of the invention, the handheld personal perineal cleansing system is configured for installation in a combination shower/bathtub using the overflow drain.

In an additional aspect of the invention, the handheld personal perineal cleansing system is configured for installation in a combination shower/bathtub using the floor drain.

In a further aspect of the invention, the handheld personal perineal cleansing system is configured for use while seated on a toilet.

In another aspect of the invention, the handheld personal cleansing system includes a specialized toilet riser to provide vertical height to accommodate the use of the handheld personal cleansing system.

The object of the invention is to provide a handheld personal perineal cleansing system which gives an improved performance over the above described prior art systems and methods.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward a handheld personal hygiene perineal cleansing system that allows a user to clean his/her perineal area while the system captures any waste and/or debris and residual water within a basin incorporated into the cleansing system. Water is introduced into the handheld personal hygiene perineal cleansing system by adding a fitting to a fixture or waterpipe of the bathroom, so it is easy to install and requires no modifications to the installed plumbing.

Figure 1:
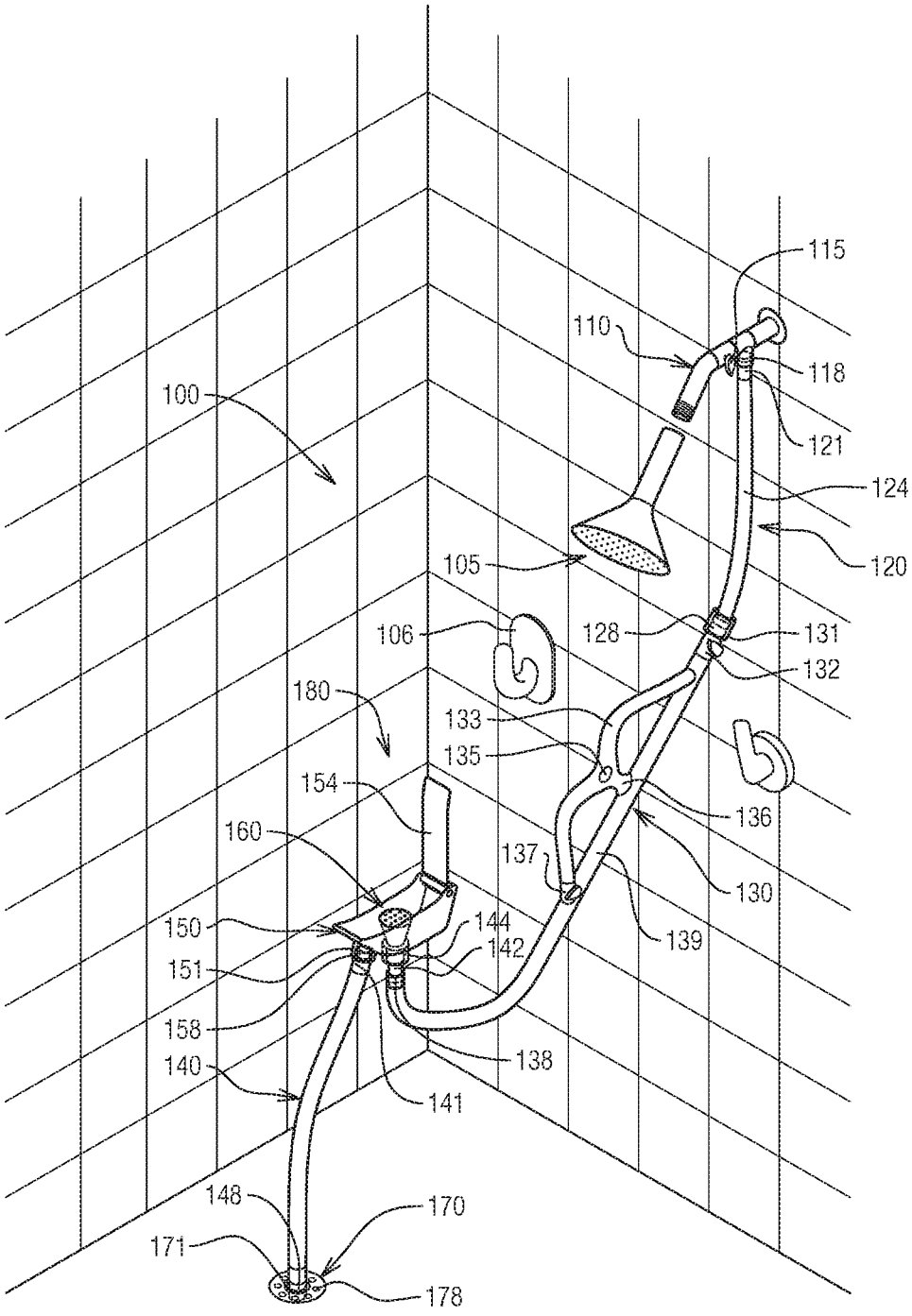
FIG. 1 is a perspective view of a first embodiment of the present invention in an exemplary environment of use, as installed in a shower stall.
Figure 2:
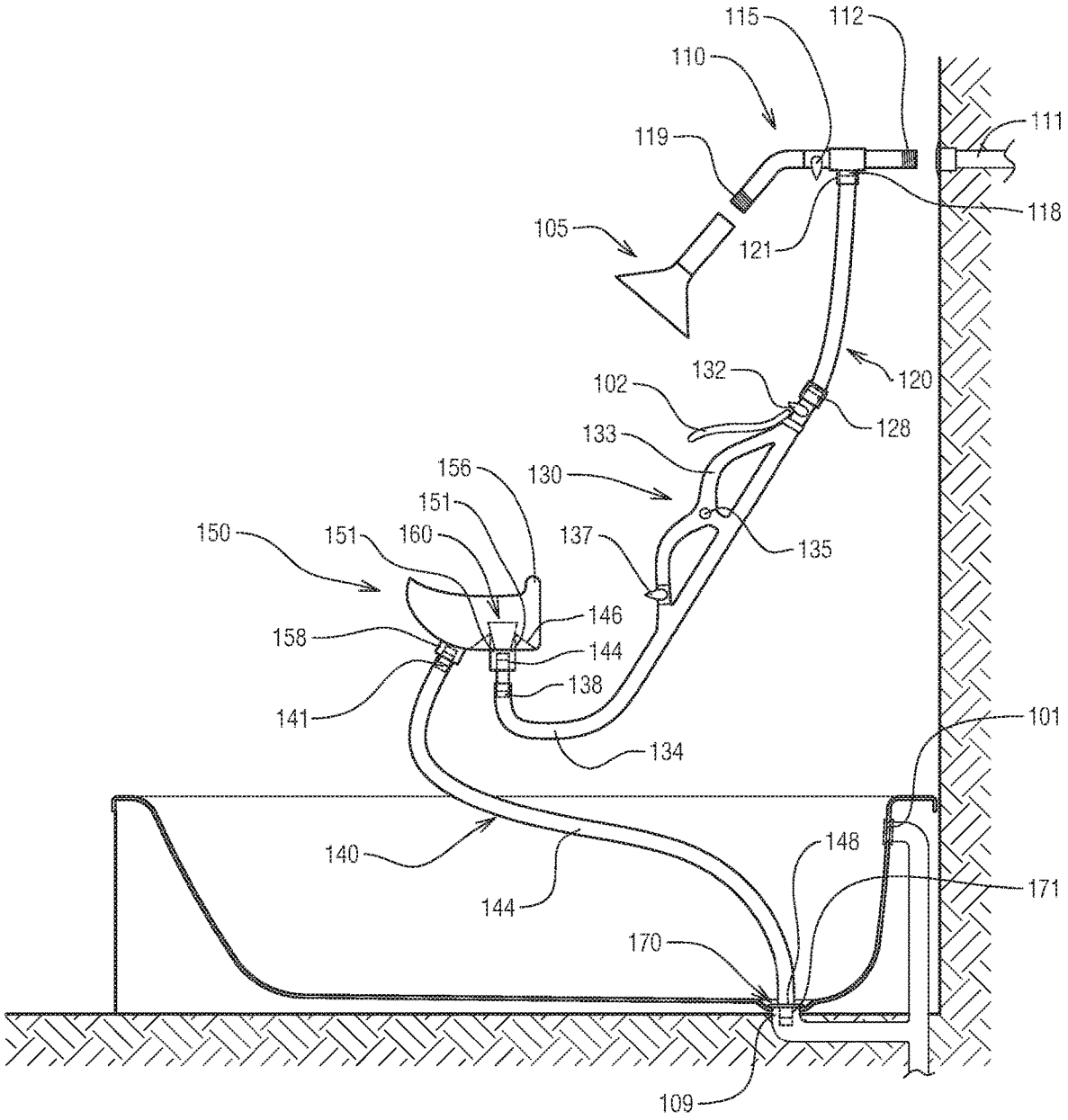
FIG. 2 is a side, partial cut-away view of a second embodiment of the present invention in an exemplary environment of use, utilizing the bathtub floor drain, with the bathtub and wall cut away to show the house plumbing.
Figure 3:
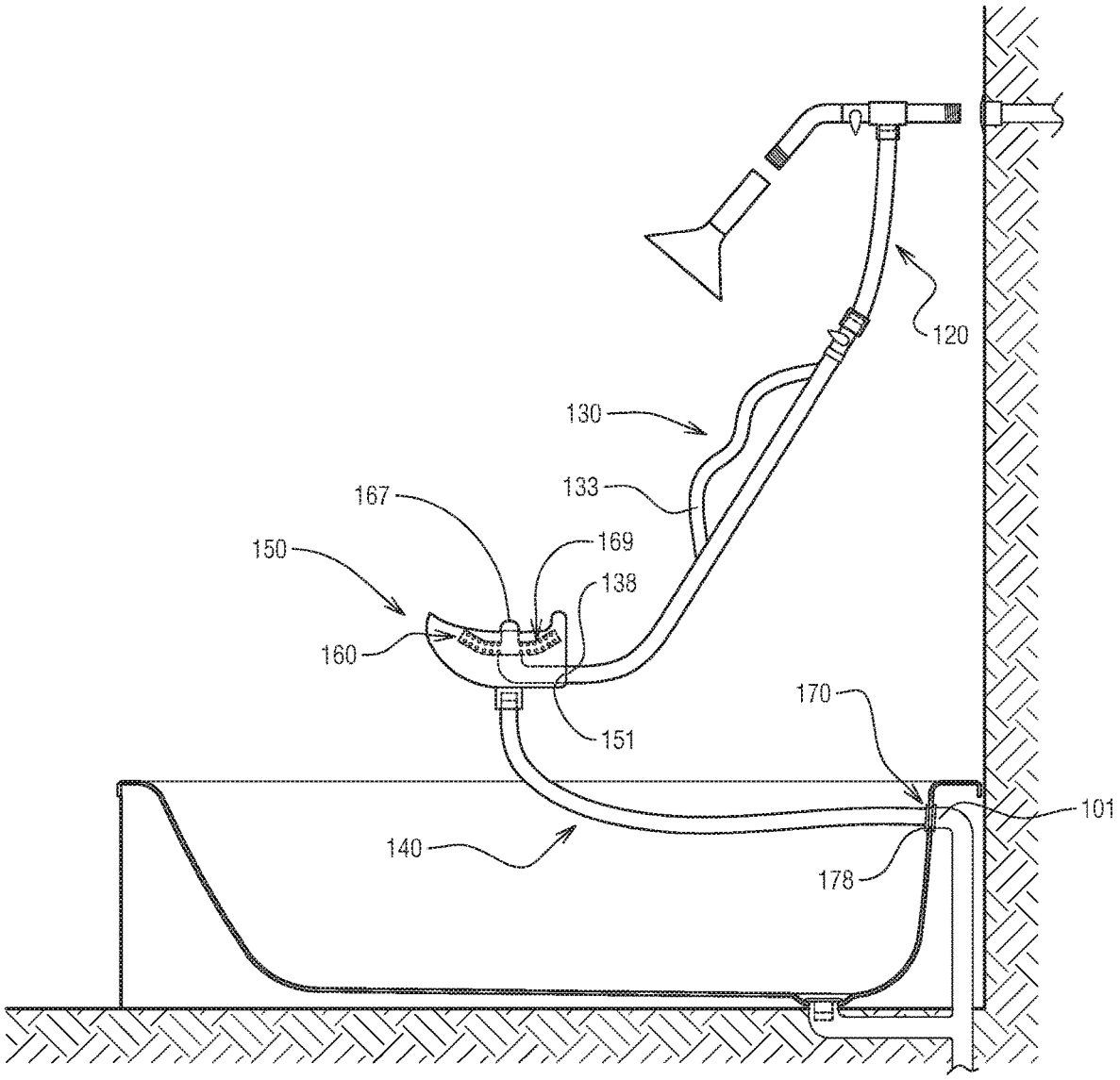
FIG. 3 is a side, partial cut-away view of a third embodiment of the present invention in an exemplary environment of use, utilizing the bathtub overflow drain, with the bathtub and wall cut away to show the house plumbing.
Figure 10:
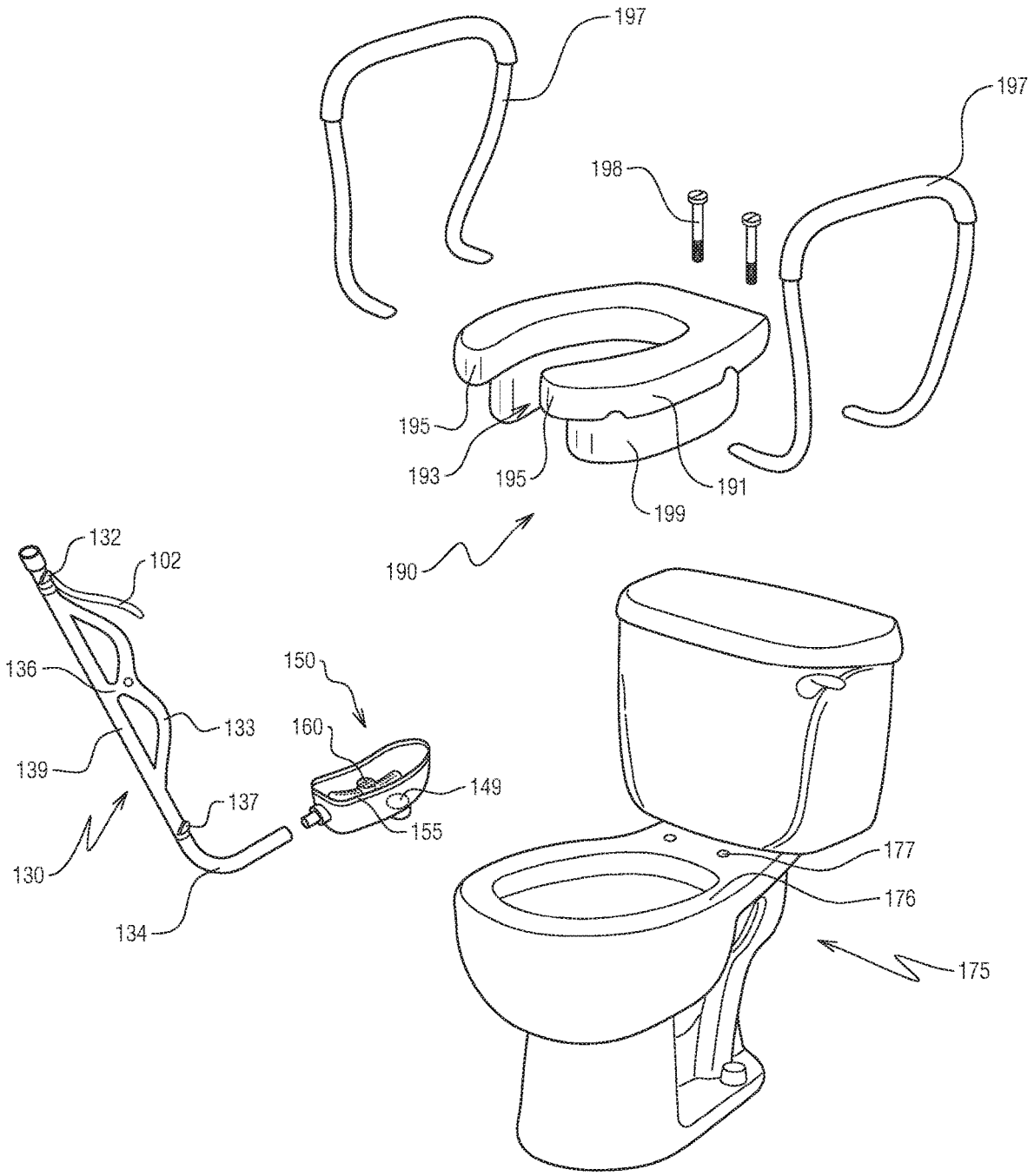
FIG. 10 is an expanded perspective view of a fourth embodiment of the present invention in an exemplary environment of use, for use with a specialized riser and toilet.
Figure 11:
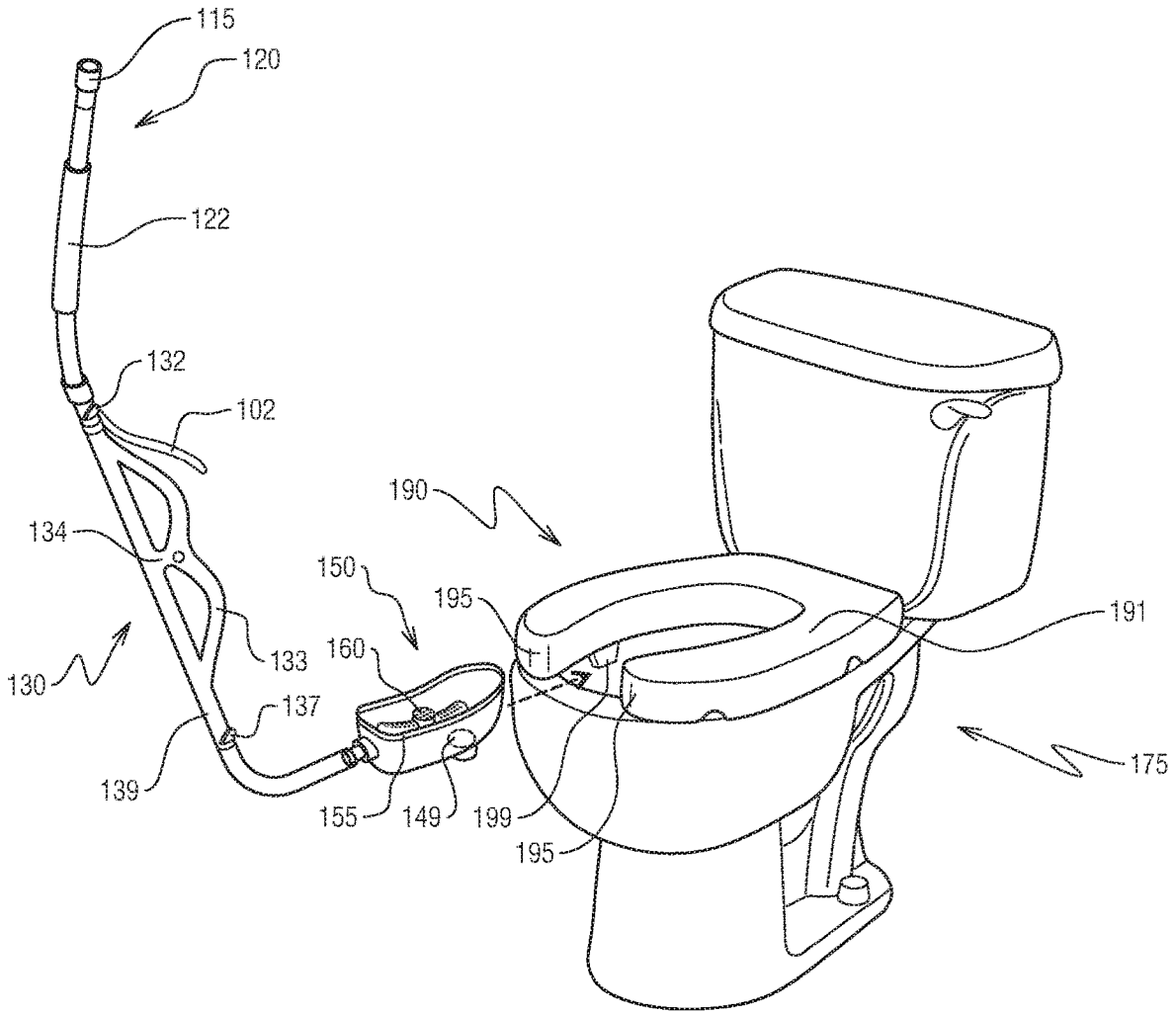
FIG. 11 is a perspective view of a fourth embodiment of the present invention in an exemplary environment of use, as used with a specialized riser and a toilet.

The personal hygiene perineal cleansing system may be installed for use in a shower, bathtub, combination shower/bathtub, or toilet. In a first embodiment is it installed in a shower using the shower floor drainpipe for drainage (FIG. 1). In a second embodiment it is installed in a combination shower/bathtub using the bathtub floor drainpipe for drainage (FIG. 2). In a third embodiment it is installed in a combination shower/bathtub using the bathtub overflow drainpipe for drainage (FIG. 3). In a fourth embodiment, it is installed near a toilet and uses the toilet for drainage (FIGS. 10-11).

In the embodiments in which the personal perineal cleansing system is installed in a shower or bathtub, the water intake may be a fitting introduced between the existing shower pipe water supply and the existing plumbing drainpipes. In the embodiment in which the personal perineal cleansing system is installed for use when seated on a toilet, the water intake may be a fitting positioned within the toilet waterlines, within waterlines supplying a sink, or within the existing shower pipe water supply.

Referring now to FIG. 1, a handheld personal hygiene perineal cleansing system, shown generally as reference number 100, is illustrated in accordance with a first embodiment of the present invention. As shown, the handheld personal hygiene perineal cleansing system 100 comprises a water-ingress fitting no that connects to and receives a fluid flow from a building's fluid flow pipe iii (FIG. 2); a water-ingress valve to control the fluid flow into the water-ingress fitting no; a flexible feeder supply line 120 that connects to and receives a fluid flow from the water-ingress fitting no; an elongated spray arm 130 that connects to and receives a fluid flow from the feeder supply line 120 and that incorporates an integrated handle 133; an accumulation basin 150 that includes a basin outlet drain 158; a sprayer 160 disposed within the accumulation basin 150 that is fluidly connected to and receives a fluid flow from the spray arm 130; a removal line 140 that connects to and receives a fluid flow from the basin outlet drain 158, and a drain fitting 170 that replaces the existing drain pipe cover and that is configured to allow attachment of the distal end of the removal line 140 while simultaneously allowing water within the shower or bathtub to drain into the building's drain pipes and eventually to the sewer lines.

One or multiples ones of the water-ingress fitting 110, flexible feeder supply line 120, spray arm 130, and handle 133 may include a plumbing valve. The water-ingress fitting no preferably comprises a tee fitting that includes a water-ingress valve 115 that can be shut to prevent fluid from flowing to the showerhead 105 and to thereby allow the water to enter the handheld personal hygiene perineal cleansing system 100. The feeder supply line 120 or the spray arm 130 preferably include a valve 132 to shut off or turn on the fluid flowing from the water-ingress fitting no to the sprayer 160. The handle 133 may optionally have a handle valve 137 to allow secondary fluid that has been introduced into a handle interior reservoir via the handle fill port 135 to flow into the main fluid flow passage of the spray arm 130. These plumbing valves 115, 132, 137 comprise shut-off valves (also known as stop valves or isolating valves), which include gate valves, globe valves, ball valves, or other similar shut-off type valves, but a ball valve type shut-off valve is preferred. The valves may include configurations such as two-port, 3-port, two-stop/one manifold, and the like. In an aspect, the valve 115 may be a two-stop valve on one manifold configuration, and the second shut-off valve 132 would not be necessary. In yet a further aspect, the valve 115 may be a 3-port valve in which the fluid flow from the ingress port 112 may be switched to the first outlet 119 or to the second outlet 118, which also eliminates the need for the second shut-off valve 132.

In a conventional bathroom, a shower or a shower/bath combination has an existing showerhead 105 configured with showerhead nozzles that provide a spray of water into the shower surround or the shower/bath combo surround. Additionally, the existing showerhead 105 has an internal water flow passage and is configured to be attached to, and receive a fluid flow from, the building's fluid flow pipe 111, which in turn has an internal water flow passage and is configured to be attached to and receive a fluid flow typically from a municipal pressurized water supply.

In the first embodiment, the water-ingress fitting 110 of the handheld personal hygiene perineal cleansing system 100 is interposed between the existing fluid flow pipe 111 (FIG. 2) and the showerhead 105. The water-ingress fitting no comprises a tee fitting with a tee inlet 112, a first tee outlet 119, a second tee outlet 118, a tee valve-type water-ingress fitting 115, and at least one internal fluid flow passage. The tee inlet 112 is configured to connect via mating connectors to, and to receive a fluid flow from, the fluid flow pipe iii. The first tee outlet 119 is configured to connect via mating connectors to, and to convey a fluid flow to, the showerhead 105 when the tee valve 115 is open. The second tee outlet 118 is configured to connect via mating connectors to, and to convey a fluid flow to, the flexible feeder supply line 120. The mating connectors of this connection and the other connections of the system 100 are standard plumbing mating connectors, such as corresponding male-female threaded portions or corresponding portions of a quick release connector. In one aspect of the invention, the fluid flow pipe iii has female threads and the tee ingress port 112 is configured with mating male threads; the first tee outlet 119 has male threads and the showerhead 105 has mating female threads; and the second tee outlet 118 and flexible feeder supply line 120 have mating male and female threads. In a further aspect of the invention, the mating connectors may be permanently and fixedly connected. In another preferred aspect of the invention, the mating connectors connecting the second tee outlet 118 and the feeder supply line 120 comprise mating portions of a quick release connector.

The flexible feeder supply line 120 comprises at least one internal fluid flow passage, a feeder supply line inlet 121, a flexible tubing 124, and a feeder supply line outlet 128. The flexible tubing 124 comprises a water supply line suitable for hot and cold water that extends from the feeder supply line inlet 121 to the feeder supply line outlet 128. Preferably the flexible tubing comprises a bendable braided line. Braided line types include braided nylon flex tubes made from reinforced braided nylon with a solid polyvinyl chloride (PVC) inner core, stainless steel flex tubes made of braided stainless steel surrounding an inner tube of PVC or nylon, PVC flex tubes made of a PVC outer core that is usually braided with nylon and an inner core made of solid PVC, polymer-coated flex tubes with outer polymer-coated fibers and an inner PVC core, and the like.

The feeder supply line outlet 128 is configured to connect to, and to convey a fluid flow to, the spray arm 130. The feeder supply line outlet 128 and the spray arm inlet 131 have mating connectors, similar to the feeder supply line inlet 121 and the second tee outlet 118 mating connectors, as described above.

The elongated spray arm 130 comprises at least one internal fluid flow passage, a spray arm inlet 131, a spray arm outlet 138, an elongated casing body 139, an at least one handle 133, and, optionally, a spray arm shut-off valve 132. The spray arm inlet 131 is configured for connecting to the feeder supply line outlet 128 via mating connectors and for receiving a fluid flow from the feeder supply line outlet 128. The elongated casing body 139 is rigid and non-flexible. It comprises an upper generally straight portion that carries the handle 133 and a lower curved or arc-shaped portion 134 (FIG. 2) that has an arc that is complementary to the shape of a human body with a portion mimicking the human body shape from the pubic bone to the coccyx bone, which allows the user to correctly position the accumulation basin 150 carrying the sprayer 160. The casing body 139 receives a fluid flow from the spray arm inlet 131 and conveys fluid to the spray arm outlet 138. The spray arm outlet 138 is configured for conveying (either indirectly through a portion of the basin 150 or directly) a fluid flow to, the inlet port 161 (FIG. 4) of the sprayer 160 disposed within the accumulation basin 150. At least one of the spray arm outlet 138 or the interiorly-disposed sprayer 160 is configured for connecting to the accumulation basin 150 in a substantially water-tight connection. In the preferred embodiment of the invention, the spray arm outlet 138 connects to a basin extension 142 fixedly attached to the basin 150 and the basin extension 142 directs the fluid flow to a quick release connector 144 to which the sprayer 160 is connectable. By usage of the quick release connector 144, it is easy to remove, clean, and replace either the sprayer 160. In another aspect, the spray arm outlet 138 connects directly to the sprayer 160, preferably with a quick release connector, and the basin 150 attaches to the sprayer 160.

The handle 133 of the spray arm 130 allows the user to position the accumulation basin 150 for maximum comfort and collection and to direct the fluid spray from the spray head 169 for maximal cleansing. In the aspect shown in FIG. 1, the handle 133 has an upper end that is fixedly attached at an upper portion of the spray arm 130 and a lower end that is fixedly attached at a middle or mid-lower portion of the spray arm 130. In this aspect of the invention, the handle 133 comprises a two-loop or two-grip handle with two outwardly curved loops and an inwardly curved middle section or waist 136. In the aspect shown in FIG. 1, the inwardly curved middle section 136 is also fixedly attached to the spray arm 130. The dual grips allow the user to have optimum control of the positioning of the sprayer 160 and accumulation basin 150. In some aspects, shown in FIGS. 1, 2, 4, 9, 10, the inwardly curved middle section 136 is attached to the spray arm 130. Attachment of the middle section 136 to the spray arm 130 enhances the robustness of the structure. However, in another aspect shown in FIG. 3, the inwardly curved handle middle section 136 is unattached to the spray arm 130, and the handle is only attached at the upper end and at the lower end. In both of these aspects, the inwardly curved middle section 136 disposed between the two outwardly curved loops guide the user in an advantageous positioning of the hands of the user and/or to encourage gripping of the loops.

In one aspect of the invention, the handle 133 includes an internal fluid storage passageway and/or reservoir, a fill port 135 preferably covered with a cap, and a fluid exit port. The handle's internal fluid storage reservoir is an interior cavity within the handle into which a secondary fluid is introduced through the handle fill port 135 and out of which the secondary fluid exits through a handle exit port. The fluid flow from the handle exit port is manually controlled by a handle shut-off valve 137 that retains the secondary fluid introduced into the fill port 135 in the storage reservoir or allows the secondary fluid in the storage passageway to flow into the lower portion of the spray arm 130. The fill port 135 allows the introduction of cleaners or disinfectants into the internal fluid storage passageway/reservoir for cleaning the accumulation basin 150, the sprayer 160, and the removal line 140. In another aspect medicaments, treatments, balms, and oils can be introduced into the fluid being sprayed onto the perineal area by the sprayer 160 via use of the fill port 135 and manual opening of the valve 137. Thus, the secondary fluid may comprise cleaners or health and beauty aids.

In another aspect of the invention, a safety lever 102 (FIGS. 2, 4) is installed that activates the shut-off valve 132 or a separate shut-off valve near the top of the spray arm 130. In the relaxed position, the valve is closed and no fluid flows into the spray arm 130. In the depressed position, the valve is open and fluid flows into the spray arm 130 and on to the sprayer 160. The inclusion of the lever 102 is a safety feature that provides the user with another layer of control. The lever 102 regulates the volume of fluid flow and so may also be used to maximize or minimize the fluid flow, thereby providing the user with volume enhanced control and additional comfort.

The sprayer 160 is disposed within the accumulation basin 150. The sprayer 160 comprises at least one internal fluid flow passage, an inlet port 161, and a spray head 169 having a nozzle matrix or assembly 168. The sprayer 16*o* is configured for receiving fluid flow from, the spray arm 130. The sprayer 160 may be directly connected to the spray arm outlet 138 via mating connectors or otherwise connected to receive the fluid flow. In the preferred aspect, the basin 150 includes a tubing extension 142 (FIG. 4) configured with a quick release connector. The extension 142 is fixedly attached to or formed integrally with the basin 150. A basin quick release connector 144 is mated to the sprayer quick release connector at sprayer inlet 161, which may be mounted on a stem 162. The fluid flows from the sprayer inlet 161 through any stem 162 into the body of the sprayer 160 and into the spray head 169 and out a nozzle 168A, 168B of the nozzle assembly or nozzle matrix 168.

The spray head 169 comprises the nozzle assembly 168, which is configured to spray a fluid flow that sprays onto and washes the perineal area. The residual fluid, carrying any dirt, bacteria, or feces that has been washed away from the perineal area, is accumulated in the accumulation basin 150. This residual fluid is received by the accumulation basin 150, flows through the basin outlet drain 158 and into the inlet 141 of the removal line 140 and on to the drain fitting 170.

In a preferred aspect of the invention, the nozzle assembly 168 of the spray head 169 comprises multiple nozzles 168A (FIG. 4) that are directed upwardly to cleanse the perineal area and additionally comprises one or more nozzles 168B that are directly outwardly and/or downwardly to wash the interior surface of the accumulation basin 150. In one aspect the nozzles 168A, 168B may all disperse similar amounts of water at similar pressure. In another aspect, some of the nozzles 168A, 168B may vary from others of the nozzles 168A, 168B in spray strength. In a further aspect, some or all the nozzles 168A, 168B may provide a pulsating spray.

In one aspect of the invention, the spray head 169 may also optionally comprise a divider shield 167 (FIG. 4) that may be manually positioned by the user for additional comfort and affords the ability to protect delicate areas from an uncomfortably strong spray. The nozzles on the forward portion of the spray head 169 may be configured to spray with a lighter force than the nozzles on the rearward portion of the spray head 169. This aspect which may provide advantages to female users, who may position the divider shield 167 between the anus and the labia to provide a softer spray to the labial area and a more vigorous spray to the anal area. Usage of the divider shield 167 may also provide separation to solve actual or perceived hygiene issues.

Figure 4:
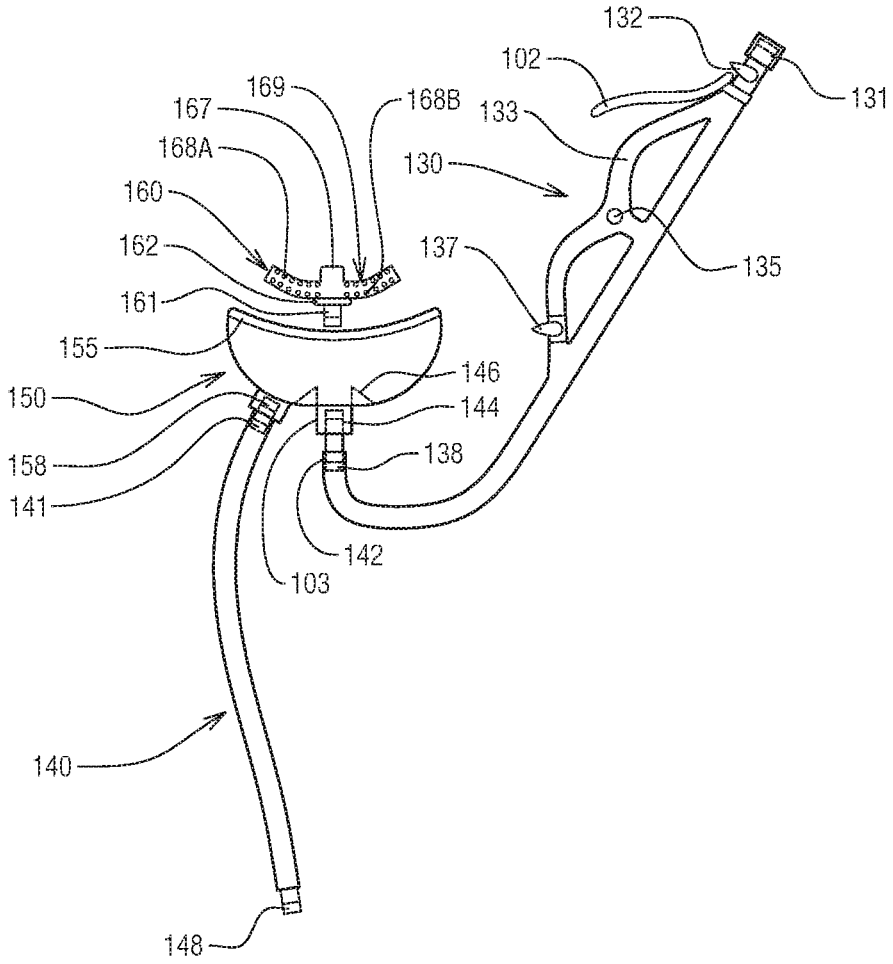
FIG. 4 is a side, partially expanded view of the accumulation basin, spray head, supply line, and water removal line of one embodiment of the present invention.
Figure 5:
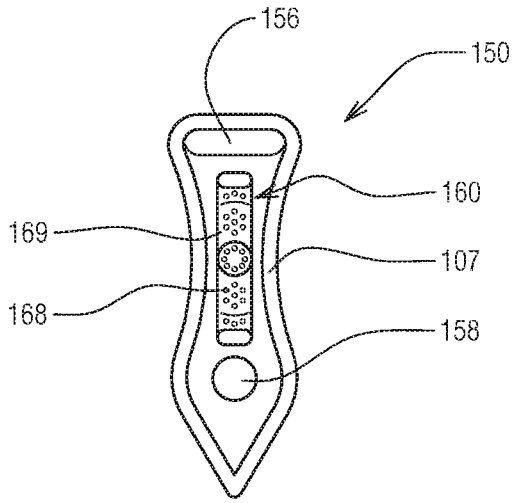
FIG. 5 is a top view of the accumulation basin and basin spray head of one embodiment of the present invention.
Figure 6:
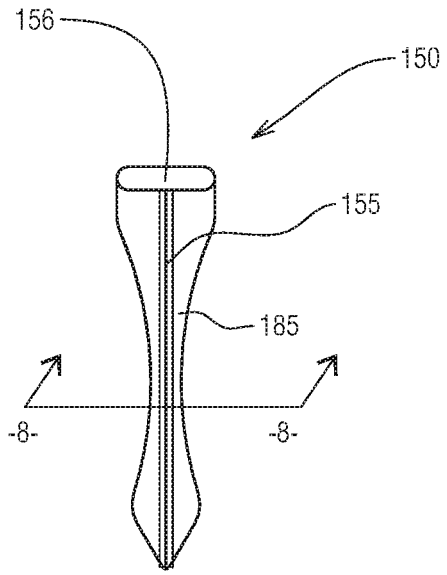
FIG. 6 is a top view of the expandable accumulation basin of another embodiment of the present invention in the relaxed, unexpanded state.
Figure 7:
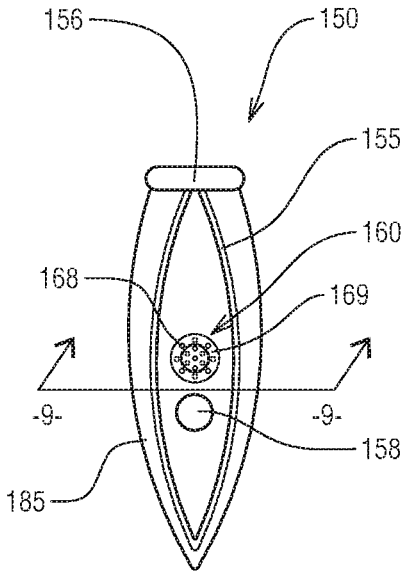
FIG. 7 is a top view of the expandable accumulation basin and basin spray head of FIG. 6 in the expanded or open state.
Figure 8:
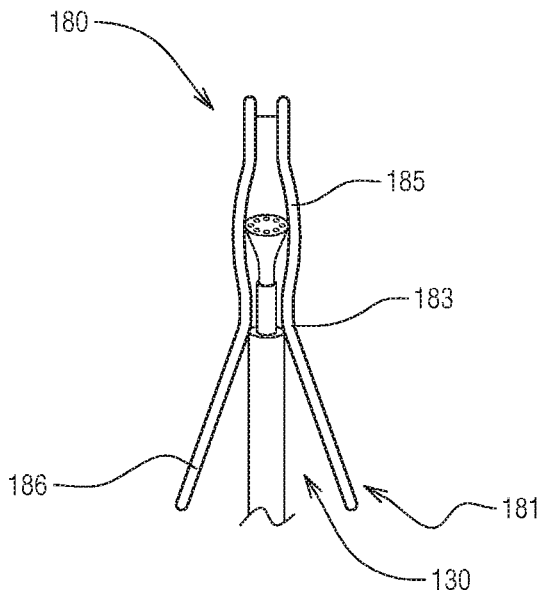
FIG. 8 is a side view of the buttocks spreader system of the expandable accumulation basin of FIG. 6.
Figure 9:
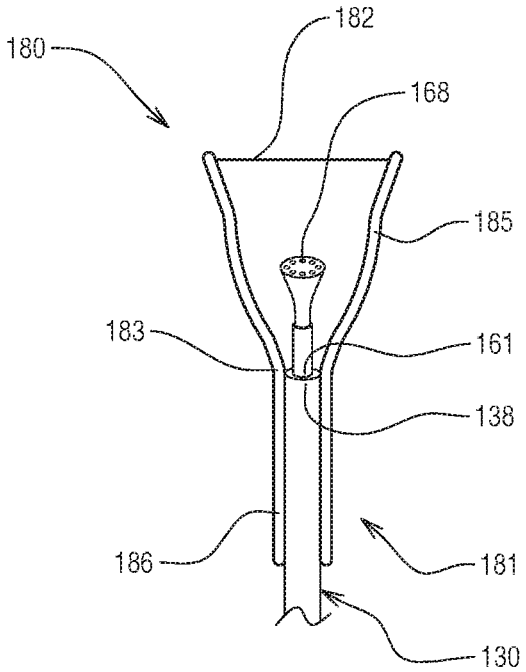
FIG. 9 is a side view of the buttocks spreader system of the expandable accumulation basin of FIG. 7.

The spray head 169 may be elongated as seen in FIGS. 3-5 or may be circular as seen in FIGS. 1-2, 7-9. In one aspect of the invention, multiple spray heads (or compound spray heads) may be included. In this aspect, each of the multiple spray heads 169 may be directed in the same or different directions, may have the same or different spray strengths, and may have the same or different spray patterns.

The accumulation basin 150 is a round or oblong concave bowl-shaped vessel that is sized and configured to accommodate the sprayer 160 disposed internally of the basin 150. Preferably, the basin 150 is an oblong, concave, one-piece molded plastic container. The accumulation basin 150 comprises an inner surface, an outer surface, a rim 155 encircling the upper edge, and two openings, an input opening 151 and a basin outlet 158 (FIGS. 2, 4). The basin outlet 158 is configured to allow residual wash fluid to drain into the removal line 140. The input opening 151 is associated with facilitating the fluid flow from the spray arm 130 to the sprayer 160 in one of the aspects described above. The input opening may be in the bottom portion of the basin 150 or in the side of the basin 150 (FIG. 3).

The inner surface of the basin 150 is smooth to facilitate removal of the residual fluid and for cleaning. Particularly in the aspect in which the input opening is at the bottom of the basin, the inner surface of the basin 150 near the input opening 151 may have a raised portion 146 (FIG. 4) that minimizes backflow into the spray arm 130. The raised portion 146 encircling the input opening 151 may be formed as a mound or angled shape with a center depression into which the sprayer inlet 161 is connected.

In some aspects of the invention, the accumulation basin 150 may comprise a lid 154 that is sized and configured to fit onto or over the rim 155. In one aspect, the lid 154 is a separate element that may be snapped onto the rim. In another aspect, the lid 154 is hingedly attached to the accumulation basin 150, as seen in FIG. 1. In a further aspect, the lid 154 may have a recessed center portion. Filling the basin 150 and placing the lid 154 with the recessed center portion onto the accumulation basin 150 will force the water in the basin 150 out of the basin 150 and over the upper rim 155. This serves to rinse the outer surfaces of the basin 150.

In one aspect, the accumulation basin 150 is connected (either directly connected or connected via a portion of the sprayer 160) to the spray arm 130. This aspect facilitates easy removal of the basin 150 from the spray arm 130 for cleaning or replacement with a separate basin 150, such as may provide advantages when two members of the same household use a single personal perineal cleansing system. In another aspect, the accumulation basin 150 may be integrally formed with the spray arm 130 forming a one-piece spray arm and basin combination element. This aspect has less connections, and, thus, may provide a more robust solution.

For comfort, in one aspect of the invention, the rim 155 of the basin 150 is covered with closed cell foam, rubber or rubber-like material, memory foam, memory foam covered in a pliant encasement for easy cleaning, or other soft material 107 (FIG. 5). Inclusion of a soft pliable material on the top rim 155 may facilitate a better fit against the body.

The flexible removal supply line 140 comprises at least one internal fluid flow passage, a removal line inlet 141 configured for connecting to (via mating connectors) and receiving a fluid flow from the basin outlet 158, a flexible line 144, and a removal line outlet 148. The flexible line 144 is preferably a braided water line as described above having a diameter as large as or larger than the diameter of the feeder supply line 120. The removal supply line 140 extends from the basin outlet 158 to the drain inlet 171. The removal line outlet 148 connects to and conveys a fluid flow (the residual wash fluid and any waste) to a drain inlet 171 of the drain fitting 170 within the bottom of the shower or the bathtub or within the overflow drain of the shower/bathtub combination.

The drain fitting 170 comprises at least one internal fluid flow passage, comprises the drain inlet 171 configured for connecting to (via mating connectors) and receiving a fluid flow from the removal line outlet 148, and comprises an external cover 178. The external cover 178 supports the drain inlet 171. The external cover 178 includes one or more external drain holes providing access to the internal fluid flow passage. In the aspect in which the drain fitting is installed within the floor of the shower or bathtub, multiple external drain holes are provided. The external drain holes allow the shower spray water or bath water to drain into the internal fluid flow passage of the drain pipes, while the drain inlet 171 receives the residual water collected by the accumulation basin 150 (and transported by the removal line outlet 148) and directs the residual water through the external cover 178 to drain into existing plumbing drain pipes.

For convenience of attaching, using, and disconnecting all or parts of the handheld personal perineal cleansing system 100, preferably one or more or all of the mating inlet/outlet combinations are quick release connectors. For example, if the feeder supply line inlet 121 and the second tee outlet 118 comprise a first mating quick release connector and if the drain inlet 171 and the removal line outlet 148 comprise a second mating quick release connector, the elements of the handheld personal perineal cleansing system 100 between the water-ingress fitting no and the drain fitting 170 may be removed by merely activating the first and second quick release connectors. In another aspect, the sprayer 160 and the spray arm outlet 138 comprise mating parts of a quick release connector, which allows the sprayer 160 to be removed for easy cleaning of the sprayer 160 elements and of the interior of the accumulation basin 150.

FIG. 1 shows the handheld personal hygiene perineal cleansing system 100 installed in a shower stall. An optional hook 106 is installed on the wall of the shower surround to enable the user to place most of the handheld personal hygiene perineal cleansing system 100 onto the hook 106 when not actively being used during a shower or for storage after completion of the shower. For example, if a quick release connector is installed at the connection between the second tee outlet 118 and the feeder supply line inlet 121 and another quick release connector is installed at the connection between the removal line outlet 148 and the drain inlet 171, all of the handheld personal hygiene perineal cleansing system 100 except for the water-ingress fitting no may be removed from the center of the shower and stored out of the way on the hook 106.

FIG. 2 shows the handheld personal hygiene perineal cleansing system 100 installed in a bathtub/shower combination. The drain fitting 170 is installed into the existing bathtub drainpipe 109 by removal and replacement of the existing drainpipe cover. FIG. 2 also illustrates an aspect in which an upwardly-extending ridge 156 extends along the front edge of the accumulation basin 150. This safeguard ridge 156 allows a user to place the accumulation basin 150 safely and securely at the desired location toward the front of the perineal area, so that the handheld personal hygiene perineal cleansing system 100 is steadily positioned.

FIG. 3 shows the handheld personal hygiene perineal cleansing system 100 installed in a bathtub/shower combination, but in this aspect, the drain fitting 170 is installed into the existing overflow drain 101 of the bathtub by removal and replacement of the existing overflow cover. The existing overflow cover is replaced by the drain fitting 170 having a drain inlet 171 to which a removal line outlet 148 may be attached and having an external drain cover 178 configured with one or more external holes through which any bath water may overflow into the building's drain lines.

FIG. 3 additionally illustrates a handle variation in which a rigid handle is attached to the spray arm 130 only at the top and bottom of the handle. In the embodiment of FIG. 3, the inwardly curved middle section 136 of the handle 133 does not attach to the spray arm 130, the handle does not include a handle fill port 135 and a handle valve 137, and the spray arm 130 does not include lever 102 to activate the safety valve 132.

In the embodiment shown in FIG. 3, the accumulation basin 150 and the spray arm 130 are formed as a single, unitary element with no removable connection between the spray arm outlet 138 and the basin inlet 151.

FIG. 4 provides an expanded view showing the lower portion of the sprayer 160 from the spray arm inlet 131 to the removal line outlet 148. In this embodiment both the accumulation basin 150 and the sprayer 160 are connected by quick release connectors for easy removal of one or both for washing. In one aspect a first quick release connector 144 is fixedly attached to the interior of the lower portion 103 of the basin 150. The sprayer inlet 161 is configured as a mating second quick release connector and attaches to the basin quick release connector 144.

In one aspect, a projection or raised portion 146 extends above the bottom of the basin with the basin quick release connector 144 disposed within the raised portion 146. This functions to prevent waste from inadvertently being introduced into the spray arm system 130.

In FIG. 4, an extension 142 from the basin 150 is configured with a quick release connector, which is configured to attach to a mating quick release connector (spray arm outlet 138).

FIG. 5 illustrates a top view of the sprayer 160 within the accumulation basin 150. The front of the accumulation basin 150 is configured with an upwardly-extending ridge 156 for safety and stability. In the aspect shown, the upper edges or rim 155 of the accumulation basin 150 and the ridge 156 are covered in a soft material 107, as described above. In an aspect, seen in FIG. 5, the basin 150 may be molded unitarily from plastic resin.

FIG. 5 also illustrates the aspect in which the sprayer 160 is elongated and has multiple types of nozzles 168A, 168B (or a nozzle assembly/matrix 168 formed of multiple nozzles 168A, 168B) that are directed in one or more directions. For example, some nozzles may provide a pulsing spray, and some may provide a steady spray, and some nozzles may direct their spray upwardly for cleansing the perineal area and some may direct theirs outwardly for cleaning the basin 150.

In an exemplary installation, the handheld personal hygiene perineal cleansing system 100 of the present invention may be installed by first removing the existing showerhead 105 from the building's fluid flow pipe 111, typically by unscrewing the showerhead 105. Teflon tape is preferably placed on the threads of the ingress port 112 and the first tee outlet 119. The ingress port 112 is screwed onto the existing fluid flow pipe 111, and the showerhead 105 is screwed onto the first tee outlet 119. In the aspect in which a quick release connection is installed at the junction of the second tee outlet 118 and the feeder supply line inlet 121, the feeder supply line inlet 121 is attached via the quick release connection to the second tee outlet 118. Preferably, when purchased, the spray arm 130 is pre-connected to the feeder supply line 120, the accumulation basin 150 and sprayer 160 are pre-connected to the spray arm 130, and the removal line 140 is pre-connected to the basin outlet drain 158. If these connections are not pre-connected, these elements are connected during installation.

The existing drain cover is then removed and the inventive drain fitting 170 is installed with a drain inlet 171 quick release connector preferably disposed in the center of the external drain cover 178. The quick release connector of the removal line outlet 148 is then connected to the quick release connector of the drain inlet 171 to complete the assembly. Optionally, a wall hook may be installed for hanging at least a portion of the handheld personal hygiene perineal cleansing system 100 on a wall for storage.

In the shower installation embodiments, to use the handheld personal hygiene perineal cleansing system 100 of the present invention the water-ingress valve 115 is turned to prevent the fluid from entering the showerhead 105 and to direct the fluid into the feeder supply line 120. The spray arm valve 132 is opened to allow the fluid to enter the spray arm inlet 131. The fluid travels through the water-ingress fitting 110, through the feeder supply line 120, through the spray arm 130 and out of the sprayer 160 disposed within the accumulation basin 150. The accumulation basin 150 collects the residual fluid carrying any unwanted debris (such as fecal material, dead skin cells, dirt, and other waste material), which flows into the removal line 140 by gravity and then flows on into the drain fitting 170 to enter the plumbing drain that leads to the sewer system.

An additional aspect of the invention, a buttocks spreader 180, is shown in FIGS. 6-9. The handheld personal hygiene perineal cleansing system 100 is designed to clean the perineum, the region of the body between the legs and buttocks that reaches from the pubic symphysis to the coccyx, and the surrounding physical structures. However, in some situations the user may not be able to readily access the portion of the perineum between the buttocks. This may be because of mobility issues, medical problems, or structural issues. In this situation, the buttocks spreader 180 may be advantageously used to first separate the buttocks and then introduce a cleansing spray from sprayer 160.

The buttocks spreader 180 attaches to the end of the spray arm 130. As seen in FIGS. 6-9, the buttocks spreader 180 comprises a leg squeeze mechanism 181, an articulation point 183, an optional membrane 182, and opposing convertible sides 185 above the articulation point that convert from shut to open. The buttocks spreader 180 is used with a sprayer 160 having an optional front ridge 156 and a spray head 169. Additionally, the buttocks spreader 180 is used with the accumulation basin 150. However, in this embodiment, the accumulation basin 150 is laterally expandable and contractible. As in the other embodiments, the expandable and contractible accumulation basin 150 comprises a basin outlet drain 158 configured to convey the fluid to the removal line 140.

The expandable and contractible basin 150 of the buttocks spreader 180, in contrast to the non-expandable accumulation basin 150 of the first embodiment, has convertible sides 185 having sufficient flexibility that they can be expanded from a narrower, relaxed state via actuation of a leg squeeze mechanism 181. The leg squeeze mechanism 181 includes two levers 186 that articulate at articulation point 183 via movement of the user's legs. When the bottom portions of the levers 186 are in the relaxed position and extend outwardly as in FIG. 8, the spreader basin 150 is closed, as in FIG. 6, with the sides 185 contracted. This reduced form factor allows the user to position the expandable and contractible accumulation basin 150 more easily. When the bottom portions of the levers are moved inwardly as the user manually squeezes the levers with the upper legs, the convertible side walls 185 of the basin 150 move outwardly to create a wider basin and to allow the sprayer 160 to be exposed, as in FIGS. 7-9.

In one aspect, the expandable and contractible basin 150 further comprises a flexible membrane 182 (FIG. 9) disposed at the front and back of the expandable basin side walls that is expanded as the side walls 185 are expanded.

To use the buttocks spreader 180, the user connects the mating portions of any quick release connectors that have been disconnected, such as for storage. Then the user places the spreader accumulation basin 150 that is closed with the sides contracted between the buttocks with the leg squeeze mechanism 181 extending downwardly from the spreader basin 150 along the upper legs. The user squeezes his/her legs together, which activates the expandable side walls 185 of the spreader basin 150 to open to expose the sprayer 160. The user then initiates the fluid flow into the sprayer 160 via the spray arm valve 132 or the safety lever 102. As in the embodiment with the non-expandable basin, the spreader basin 150 collects the residual fluid and debris, which is directed into the removal line 140 and on into the drain via the drain fitting 170.

In an embodiment, shown in FIGS. 10-11, the handheld personal hygiene perineal cleansing system 100 is configured for use while the user is sitting on the toilet. This embodiment may be preferred by some users or, in some instances, a user may not be able to stand in the shower or bath/shower combination to use the personal perineal cleansing system.

Although some toilets 175 may already be configured in a manner that allows usage of the personal perineal cleansing system, most toilets 175 are likely to require installation of a riser 190 to allow usage. In one aspect, the riser 190 comprises a generally U-shaped seat 191 having a front opening 193 and a riser attachment mechanism to secure the riser 190 to the top of the toilet 175.

The riser attachment mechanism may be one or more mechanical attachments 198 or may be a securing portion 199 of the riser. For example, mechanical attachments may be bolts that attach the back of the riser using the conventional holes 177 disposed at the back of the toilet rim. Or in another example, mechanical attachments 198 may be clamps that extend from the bottom of the riser 190 to engage the top portion of the toilet bowl.

The securing portion 199 of the riser also functions to secure the riser 190 to the top of the toilet 175. For example, the riser securing portion 199 may be positioned at the bottom portion of the riser and may take the form of an insert that extends downwardly from the riser into the toilet bowl.

When installed onto a toilet, the generally U-shaped seat 191 of the riser extends along both sides and the back of the toilet rim. The U-shaped seat 191 provides an increased vertical dimension, as compared to the toilet without the riser to facilitate use of the personal perineal cleansing system. The riser seat 191 comprises a top surface, a bottom surface, and side walls 191 that extend vertically from the seat top surface to the seat bottom surface. The side walls 191 include both inner side walls disposed in the interior of the U-shape and outer side walls disposed on the exterior of the U-shape. Disposed at the front of the riser walls 191 (at the peak of the arms of the U-shape, which is forward on the toilet) are rounded riser front walls 195 that define a riser front opening 193. The riser front opening 193 is sized and configured to allow insertion of the personal perineal cleansing system into the front of the riser 190. The riser front walls 195 preferably form a rounded front portion of the U-shape of the seat 191 portion of the riser 190.

In one optional aspect, side handles 197 may be included with the riser 190, which are preferably attachable and detachable from the riser, as needed. The inclusion of an option with side handles 197 may provide advantages to some users with disabilities or limitations, such as for use after back surgery to allow the user to ease into, and out of, a sitting position.

In a second optional aspect, as seen in FIG. 11, an inline water heater 122 is configured to warm or heat the water to be used. The inline water heater 122 may be warm the water through use of electric power, battery power, or mechanical power.

This embodiment for use with a toilet 175, shares many similarities with the above-described embodiments. However, besides the difference in the usage of a riser 190, this embodiment differs in some aspects. The basin 150 may be designed with less vertical height to facilitate use. The angle of the curved portion 134 of the spray arm 130 may differ. And the basin 150 may be designed with a drain hole 149 instead of a removal supply line 140 and its accompanying components.

In this embodiment as in the embodiments above, the basin 150 is preferably oblong with rounded corners and with a smooth interior to facilitate cleaning. However, the basin 150 of this embodiment preferably has a reduced vertical height to facilitate insertion into the riser front opening 193. The basin 150 remains at least as tall as the sprayer 160, but the sprayer 160 may be inset lower into the bottom of the basin than in the earlier embodiments. Any of the types of sprayers 160 described above may be used.

Also, in contrast to the earlier embodiments, the basin 150 of this embodiment is not connected to a removal supply line 140, because the residual water and debris can drain directly into the toilet. In this case, the bottom of the basin 150 is configured with a drain hole 149. Drain hole 149 may merely be a hole cut into or molded into the bottom of the basin, may be a lined hole, may be a hole with an attached short tubular structure extending downwardly, or other opening providing access to the exterior of the basin.

The angle of the curved portion 134 of the spray arm 130 of this embodiment varies from the angle of the curved portion 134 of the spray arm 130 of the earlier embodiments, because the position of the user has changed from standing to sitting. Thus, in this embodiment, the angle of the curved portion 134 may be generally ninety-degrees. To use, the user grasps the handle 133 and pulls the basin holding the sprayer 160 toward the user.

In this embodiment of FIGS. 10-11, some elements may need to be adapted to attach to the available water supply, with the selection of the water supply to be used based on factors such as bathroom layout, distances, waterline availability, and aesthetics. For example, if the sink is near the toilet and the waterline is available, the water-ingress fitting 110 may be connect to the waterline under or near the sink, and the flexible feeder supply line 120 may be longer than in the earlier embodiments used in a shower or shower/bath. The supply line 120 may be run directly from under or near the sink, may extend through a hole in a cabinet supporting the sink, or may be installed in a manner appropriate for the bathroom layout, distances, and aesthetics. However, if the shower/bath combination is near the toilet, the personal perineal cleansing system may be attached to the showerhead 105, as described above. Or, as may be appropriate in a different layout, the water-ingress fitting 110 may be connected to the water piping behind the toilet 175 or under the toilet tank.

In any of the embodiments, one or more gaskets (such as gasket 162 in FIG. 4) may be used to achieve a tight seal at any connection or at all the connections.

The handheld personal hygiene perineal cleansing system 100 may further include a hand plunger that attaches to or near the removal line outlet 148. The optional hand plunger is configured to allow a user with limited mobility to attach the removal line outlet 148 to the drain inlet 171 without bending over.

The cleansing system 100 of the present invention is specifically designed to efficiently clean the perineal area. It provides advantages to those with limited mobility, but also to all others who want to clean the perineal area. Use of the system not only cleanses the skin, it does so without the residual wastewater or any fecal residue touching the floor of the bathtub or shower. Further, no alternations to the household plumbing are required, no reconstruction of the bathroom is needed, and it does not require additional floor space to install, as would a bidet.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A personal perineal cleansing system comprising:

a water-ingress fitting comprising at least one fluid flow passage therethrough, wherein said water-ingress fitting is configured to connect to and convey fluid from a waterpipe;

a flexible feeder supply line comprising at least one fluid flow passage therethrough, a feeder supply line inlet configured for connecting to and receiving a fluid flow from said water-ingress fitting, a feeder supply line outlet, and a feeder flexible tubing extending between said feeder supply line inlet and said feeder supply line outlet;

an elongated spray arm comprising at least one fluid flow passage therethrough; a spray arm inlet configured for connecting to and receiving a fluid flow from said feeder supply line outlet; a spray arm outlet; a non-flexible elongated spray arm body configured for connecting to and receiving a fluid flow from said spray arm inlet and for connecting to and conveying fluid to said spray arm outlet; and a handle fixedly connected to said elongated spray arm body;

a basin comprising a basin inlet and a basin outlet; and a spray head comprising a spray head inlet configured for receiving a fluid flow from said spray arm outlet and a spray head nozzle assembly configured to spray a fluid.

2. The personal perineal cleansing system as recited in claim 1, wherein said handle comprises a dual-grip handle comprising two outwardly curved loops with an inwardly curved middle section disposed between said two outwardly curved loops; wherein said dual-grip handle further comprises an upper end and a lower end, both of which are attached to said elongated spray arm.

3. The personal perineal cleansing system as recited in claim 2, wherein said inwardly curved middle section is attached to said elongated spray arm.

4. The personal perineal cleansing system as recited in claim 2, wherein said personal perineal cleansing system further comprises:

a flexible removal line comprising at least one fluid flow passage therethrough, a removal line inlet configured for connecting to and receiving a fluid flow from said basin outlet, a removal line outlet, and a removal flexible tubing connecting said removal line inlet and said removal line outlet; and a drain fitting comprising a drain inlet fitting configured for connecting to and receiving a fluid flow from said removal line outlet.

5. The personal perineal cleansing system as recited in claim 1, wherein said personal perineal cleansing system further comprises:

a flexible removal line comprising at least one fluid flow passage therethrough, a removal line inlet configured for connecting to and receiving a fluid flow from said basin outlet, a removal line outlet, and a removal flexible tubing connecting said removal line inlet and said removal line outlet; and a drain fitting comprising a drain inlet fitting configured for connecting to and receiving a fluid flow from said removal line outlet.

6. The personal perineal cleansing system as recited in claim 1, wherein said personal perineal cleansing system further comprises a riser comprises a generally U-shape when viewed from the top, whereby the riser conforms generally to a shape of the sides and back of a toilet rim; wherein said riser comprises a upper seating surface, a lower surface, and side walls extending between said upper seating surface and said lower surface; wherein said side walls comprise two opposing rounded front walls disposed at a forward portion of said U-shape to define a front opening having a vertical height similar to the vertical height of said basin.

7. The personal perineal cleansing system as recited in claim 1, wherein said personal perineal cleansing system further comprises an inline water heater for warming said fluid.

8. The personal perineal cleansing system as recited in claim 1, wherein said handle further comprises an interior reservoir, a handle input port fluidly connected to said interior reservoir and configured to allow a secondary fluid to be introduced into said interior reservoir; and a handle shut-off valve that functions to retain said secondary fluid within said interior reservoir or to allow said secondary fluid to flow into said spray arm.

9. The personal perineal cleansing system as recited in claim 1, wherein said spray head nozzle assembly comprises nozzles directed upwardly for spraying the perineal area and nozzles directed outwardly for spraying the interior of said basin.

10. The personal perineal cleansing system as recited in claim 1, further comprising a buttocks spreader comprising a leg squeeze mechanism, an articulation point, and opposing convertible basin sides that expand from a closed position to an open position based on activation of said leg squeeze mechanism.

11. The personal perineal cleansing system as recited in claim 1, wherein said handle comprises a handle fluid interior reservoir disposed within at least a portion of said handle; comprises a handle fill port configured to allow the introduction of a secondary fluid into said handle fluid interior reservoir; comprises a handle fluid exit port configured to allow the exiting of said secondary fluid; and comprises a handle exit valve that controls the exit of said secondary fluid from said handle exit port.

12. The personal perineal cleansing system as recited in claim 1, further comprising a safety lever configured to activate a safety shut-off valve to allow said fluid to flow into said spray arm and on to said sprayer.

13. The personal perineal cleansing system as recited in claim 12, wherein said safety shut-off valve regulates the volume of flow of said fluid.

14. A method of use of a handheld cleansing system for cleansing a perineal area, comprising:

obtaining a handheld cleansing system fluidly connected to a waterpipe carrying water; said handheld cleansing system comprising a water-ingress valve for controlling entrance of water into said handheld cleansing system; an elongated spray arm comprising at least one water flow passage therethrough, a spray arm inlet, a spray arm outlet, and a handle; a basin comprising a basin inlet, a basin outlet, and an interior sprayer, wherein said basin is attached to said spray arm outlet;

grasping said handle to manually maneuver said elongated spray arm with said basin attached;

positioning said basin adjacent to said perineal area;

manipulating said water-ingress valve to allow said water to flow into said handheld cleansing system;

spraying water onto said perineal area to rinse said perineal area, whereby any waste or debris is removed; and allowing said water and said any waste or debris to drain out of said basin through said basin outlet.

15. The method of use of a handheld cleansing system for cleansing a perineal area, as recited in claim 14, wherein said handheld cleansing system further comprises a removal line comprising at least one fluid flow passage therethrough, a removal line inlet configured for connecting to and receiving a fluid flow from said basin outlet, a removal line outlet, and a removal flexible tubing connecting said removal line inlet and said removal line outlet; and a drain fitting for connecting to and receiving a flow of said water from said removal line outlet.

16. The method of use of a handheld cleansing system for cleansing a perineal area, as recited in claim 14, wherein said handle comprises an upper outwardly curved loop, a lower outwardly curved loop, and an inwardly curved middle section disposed between said upper outwardly curved loop and said lower outwardly curved loop; the method further comprising:

gripping said upper outwardly curved loop with a first hand; and gripping said lower outwardly curved loop with a second hand.

17. The method of use of a handheld cleansing system for cleansing a perineal area, as recited in claim 14, wherein said handle comprises a handle fluid interior reservoir disposed within at least a portion of said handle; comprises a handle fill port configured to allow the introduction of a secondary fluid into said handle fluid interior reservoir; comprises a handle fluid exit port configured to allow the exiting of said secondary fluid; and comprises a handle exit valve that controls the exit of said secondary fluid from said handle exit port.

18. The method of use of a handheld cleansing system for cleansing a perineal area, as recited in claim 14, wherein said handheld cleansing system further comprises a safety lever configured to activate a safety shut-off valve; the method further comprising:

operating said safety shut-off valve by activating said safety lever to allow said water to flow into said spray arm and on to said sprayer.

19. The method of use of a handheld cleansing system for cleansing a perineal area, as recited in claim 14, wherein said handheld cleansing system further comprises a riser attached to a toilet rim; wherein said riser comprises a riser front opening; the method further comprising:

introducing said basin into said riser front opening.

20. The method of use of a handheld cleansing system for cleansing a perineal area, as recited in claim 14, wherein said handheld cleansing system further comprises a quick release connector between said basin and said spray arm; the method further comprising:

operating said quick release connector to attach said basin to said spray arm.

* * * * *